US012527398B2

(12) United States Patent
Raid et al.

(10) Patent No.: US 12,527,398 B2
(45) Date of Patent: Jan. 20, 2026

(54) DEVICE FOR LATERALLY GUIDING THE UPPER END OF A PULL-OUT FURNITURE PART

(71) Applicant: FULTERER AG & CO KG, Lustenau (AT)

(72) Inventors: Karl Raid, Hohenweiler (AT); Robert Moosmann, High Point, NC (US)

(73) Assignee: FULTERER AG & CO KG, Lustenau (AT)

( * ) Notice: Subject to any disclaimer, the term of this patent is extended or adjusted under 35 U.S.C. 154(b) by 118 days.

(21) Appl. No.: 18/682,282

(22) PCT Filed: Aug. 3, 2022

(86) PCT No.: PCT/EP2022/071767

§ 371 (c)(1),
(2) Date: Feb. 8, 2024

(87) PCT Pub. No.: WO2023/016878

PCT Pub. Date: Feb. 16, 2023

(65) Prior Publication Data

US 2024/0365977 A1 Nov. 7, 2024

(30) Foreign Application Priority Data

Aug. 13, 2021 (AT) ..... A 139/2021

(51) Int. Cl.
*A47B 88/42* (2017.01)
*A47B 88/477* (2017.01)

(52) U.S. Cl.
CPC ..... *A47B 88/42* (2017.01); *A47B 88/477* (2017.01); *A47B 2210/0062* (2013.01)

(58) Field of Classification Search
CPC ... A47B 88/42; A47B 88/0485; A47B 88/473; A47B 88/477; A47B 2210/0018;
(Continued)

(56) References Cited

U.S. PATENT DOCUMENTS 1,896,346 A * 2/1933 Bolhuis ..... A47B 88/487 312/334.26
2,223,071 A * 11/1940 Koch ..... A47B 88/487 312/334.25

(Continued)

FOREIGN PATENT DOCUMENTS

AT 511059 B1 * 9/2012 ..... A47B 88/57
AT 511092 B1 * 9/2012 ..... A47B 88/42

(Continued)

OTHER PUBLICATIONS

International Search Report for corresponding PCT application No. PCT/EP2022/071767, filed Aug. 2, 2022.

(Continued)

*Primary Examiner* — Andrew Roersma
(74) *Attorney, Agent, or Firm* — Notaro, Michalos & Zaccaria P.C.

(57) ABSTRACT

A device is described for laterally guiding an upper end of a pull-out furniture part. A guide rail is secured to the furniture body and a rotary part guided in parallel to the pull-out direction by the guide rail. The rotary part is pivotally mounted on a mounting part that can be secured to the pull-out furniture part. The mounting part can be moved from a pushed-in position into a pulled-out position via a movement path, wherein, in the pushed-in position of the mounting part, the rotary part is in contact with a push-in end stop of the guide rail and adopts a pushed-in rotary position, and in the pulled-out position of the mounting part, it is in contact with a pull-out end stop of the guide rail and adopts a pulled-out rotary position, which is rotated about the axis of rotation relative to the pushed-in rotary position.

11 Claims, 8 Drawing Sheets

Figure 1:
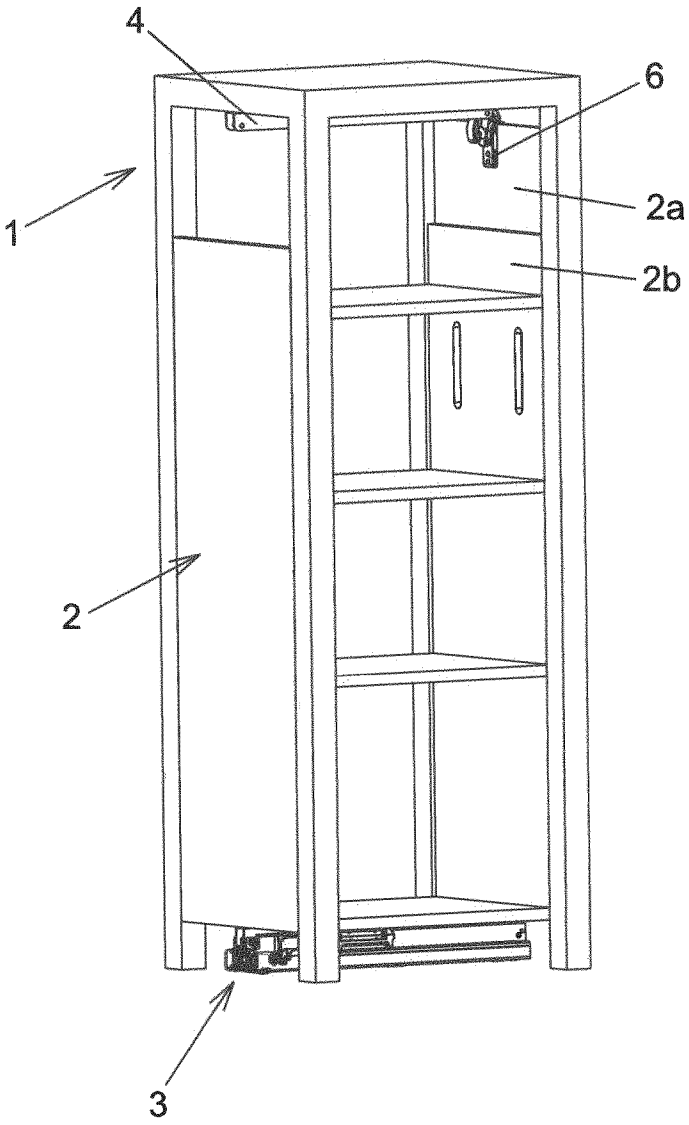

(58) Field of Classification Search
CPC .... A47B 2210/0062; A47B 2210/0091; A47B 2210/0094
See application file for complete search history.

(56) References Cited

U.S. PATENT DOCUMENTS

| | | | | | |
|---|---|---|---|---|---|
| 2,508,269 | A * | 5/1950 | Koch | A47B 88/437 312/331 |
| 2,948,578 | A * | 8/1960 | Himelreich | A47B 88/487 312/334.26 |
| 3,387,906 | A * | 6/1968 | Edwards | A47B 88/497 312/334.25 |
| 3,784,274 | A | 1/1974 | Holmes et al. | |
| 2017/0238709 | A1* | 8/2017 | Chen | A47B 88/483 |
| 2017/0340113 | A1* | 11/2017 | Charest | A47B 88/53 |

FOREIGN PATENT DOCUMENTS

| | | | | | |
|---|---|---|---|---|---|
| DE | 202005001998 | U1 * | 6/2006 | A47B 88/42 |
| DE | 102014114134 | A1 * | 3/2016 | A47B 88/42 |
| EP | 1384420 | A1 * | 1/2004 | A47B 88/467 |
| EP | 1721547 | A1 | 11/2006 | |
| EP | 1785060 | A1 * | 5/2007 | A47B 88/467 |
| FR | 444393 | A * | 10/1912 | |
| GB | 102783 | A * | 12/1916 | A47B 88/41 |
| GB | 152133 | A * | 10/1920 | A47B 88/487 |
| KR | 101289321 | B1 * | 7/2013 | E05B 65/46 |

OTHER PUBLICATIONS

International Application Status Report for corresponding PCT application No. PCT/EP2022/071767, downloaded Jan. 22, 2024.

* cited by examiner

DEVICE FOR LATERALLY GUIDING THE UPPER END OF A PULL-OUT FURNITURE PART

The invention relates to a device for laterally guiding the upper end of a pull-out furniture part which can be pulled out from a position completely pushed into a furniture body in a pull-out direction to a position completely pulled out from the furniture body, comprising a guide rail which can be fastened to the furniture body and the longitudinal extent of which is parallel to the pull-out direction.

A device of the type mentioned at the beginning is shown in EP 1 721 547 B1. The device is used to laterally guide the upper end of a pull-out tall unit section to prevent it from tilting sideways. The pull-out tall unit section is arranged upright on a lower pull-out guide. The device for lateral guidance of the upper end of the pull-out tall unit section has telescopical pull-out rails. A carcase rail is attached to the furniture body. An upper frame leg of the pull-out tall unit section is designed as a pull-out rail. A middle rail is arranged in between. This allows the pull-out tall unit section to be fully pulled out or over-pulled-out. The design is robust and functional, but also relatively complex. It also requires installation space in relation to the height due to the three interlocking rails, which reduces the usable height of the pull-out larder unit section. In addition, when the pull-out larder unit section is pulled out, the device extends over the depth of the pull-out larder unit section, which means it gets in the way of loading the pull-out larder unit section from above. This can be particularly undesirable with pull-out units that are not too high.

The task of the invention is to provide an advantageous device of the type mentioned at the beginning, which enables a full pull-out or over-pull-out of the pull-out furniture part with a simple design. According to the invention, this is achieved by a device with the features of claim 1.

The device according to the invention has a rotary part which is guided by the guide rail parallel to the pull-out direction and which is mounted on a mounting part so as to be pivotable about a horizontal axis of rotation lying at right angles to the pull-out direction. The mounting part can be attached to the pull-out furniture part, in particular in the area of its rear end in relation to the pull-out direction. The mounting part can be moved from a push-in position, which can be occupied by the mounting part when the pull-out furniture part is fully pushed in, in the pull-out direction via a displacement path into a pull-out position, which can be occupied by the mounting part when the pull-out furniture part is fully pulled out. In the push-in position of the mounting part, the rotary part rests against a push-in end stop of the guide rail, whereby it has a push-in rotational position about the axis of rotation relative to the mounting part. In the pull-out position of the mounting part, the rotary part rests against a pull-out end stop of the guide rail, whereby it assumes a pull-out rotational position about the axis of rotation relative to the mounting part. The pull-out rotational position is rotated about the axis of rotation relative to the push-in rotational position, preferably by more than 60°, particularly preferably by more than 90°.

By rotating the rotary part guided by the guide rail around the axis of rotation, the displacement path over which the mounting part can be displaced between the push-in position and the pull-out position can be extended. This displacement path can therefore be longer than the distance between the push-in end stop and the pull-out end stop of the guide rail.

In this relatively simple design, a lateral guide for a full pull-out or over-pull-out of the pull-out furniture part can be realized.

If the mounting part is mounted on the pull-out furniture part in the region of the rear end of the pull-out furniture part in relation to the pull-out direction, access to the pull-out furniture part from above is not obstructed by the device for lateral guidance of the pull-out furniture part according to the invention. The pull-out furniture part can thus be loaded from above.

The usable height of the pull-out furniture part can also be maximized.

Preferably, when the mounting part is displaced in the pull-out direction, starting from the push-in position of the mounting part, a rotation of the rotary part about the axis of rotation relative to the mounting part is effected at least over an initial section of the displacement path by the interaction of the rotary part with a first engagement element of the guide rail, the rotational position of the rotary part about the axis of rotation relative to the mounting part remaining unchanged during the further displacement of the mounting part over a main section of the displacement path adjoining the initial section.

It is preferable that when the mounting part is displaced in the pull-out direction, at least over one end section of the displacement path before the pull-out position of the mounting part is reached, a rotation of the rotary part about the axis of rotation relative to the mounting part is brought about by the interaction with a second engagement element of the guide rail.

However, it would also be conceivable and possible for such a rotation of the rotary part about the axis of rotation relative to the mounting part to be effected either only via the initial section of the displacement path or only via the end section of the displacement path of the mounting part.

If, when the mounting part is displaced over the initial section of the displacement path, a rotation of the rotary part about the axis of rotation is effected, which is preferred, this rotation of the rotary part is advantageously damped by a damper when the mounting part is pushed in against the pull-out direction over the initial section of the displacement path until the push-in position of the mounting part is reached.

If, when the mounting part is pulled out in the pull-out direction, a rotation of the rotary part about the axis of rotation is effected via the end section of the displacement path, which is preferred, this rotation is advantageously damped by a damper.

In particular, a single damper can be provided, which damps both the pull-out of the mounting part via the end section of the displacement path and the push-in of the mounting part via the initial section of the displacement path.

A rotational damper is advantageously provided to dampen the displacement of the mounting part over the end section of the displacement path when the mounting part is pulled out and/or over the initial section of the displacement path when the mounting part is pushed in. In this case, the rotary part can have a toothing coaxial to the axis of rotation, which meshes with a toothing coupled to the damper running along a circle or arc of a circle.

The guide rail advantageously has a receiving space defined by first and second side legs, which is open at the bottom, with the rotary part projecting into this receiving space from below. The side legs protrude favorably downwards from a horizontal base bar. The guide rail therefore has a U-shaped cross-section.

Advantageously, the insertion end stop is formed by a section of the lateral surface of a pin of the guide rail, which engages in a link motion contour of the rotary part when the mounting part is displaced over the initial section of the displacement path. This pin forms a first engagement element of the guide rail, which causes the rotary part to rotate about the axis of rotation when the mounting part is displaced over the initial section of the displacement path.

The pull-out end stop is advantageously formed by a section of the lateral surface of a pin of the guide rail, which engages in a link motion contour of the rotary part when the mounting part is displaced over the end section of the displacement path. This pin forms a second engagement element of the guide rail, which causes the rotary part to rotate about the axis of rotation when the mounting part is displaced over the end section.

Figure 2:
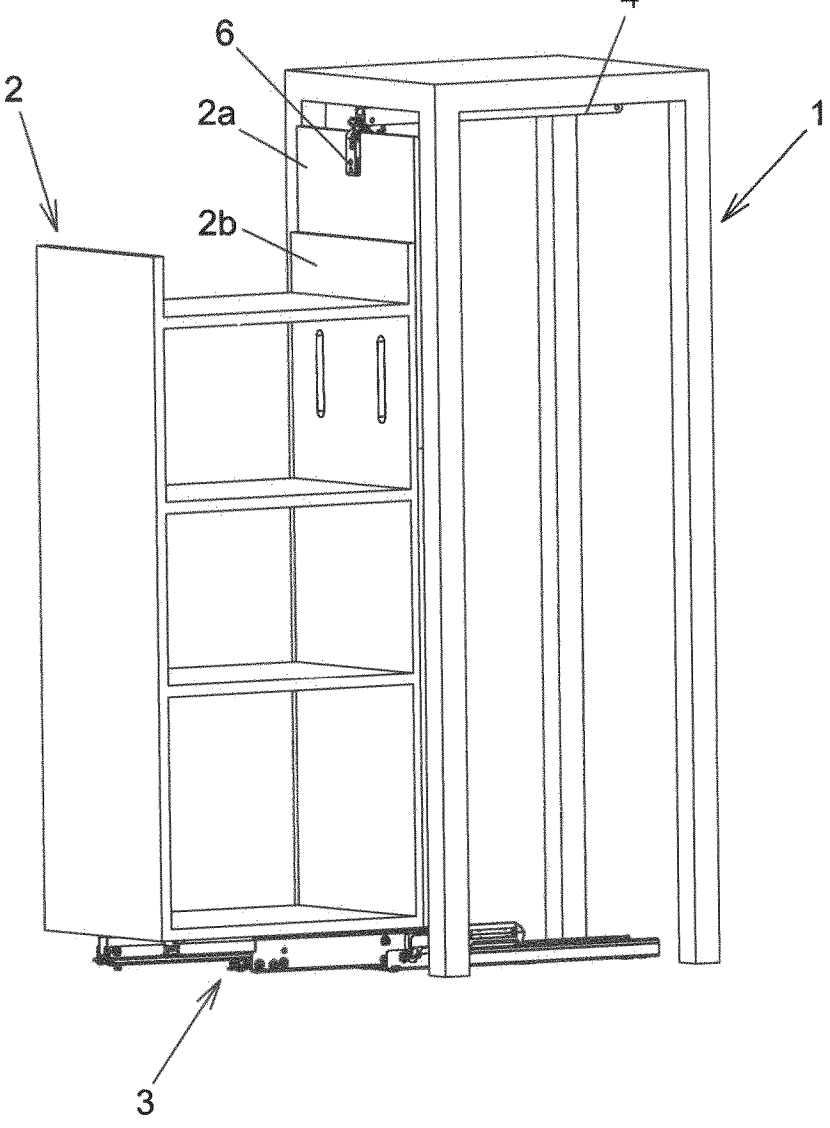
Figure 4:
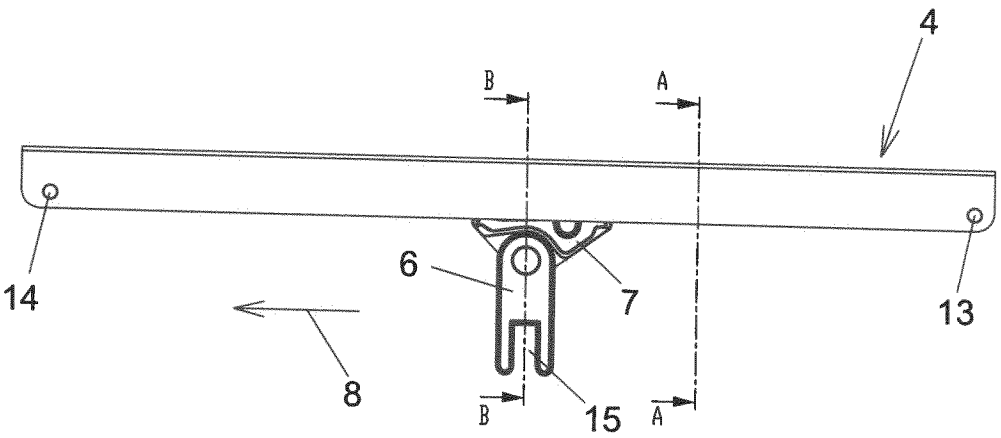
Figure 3:
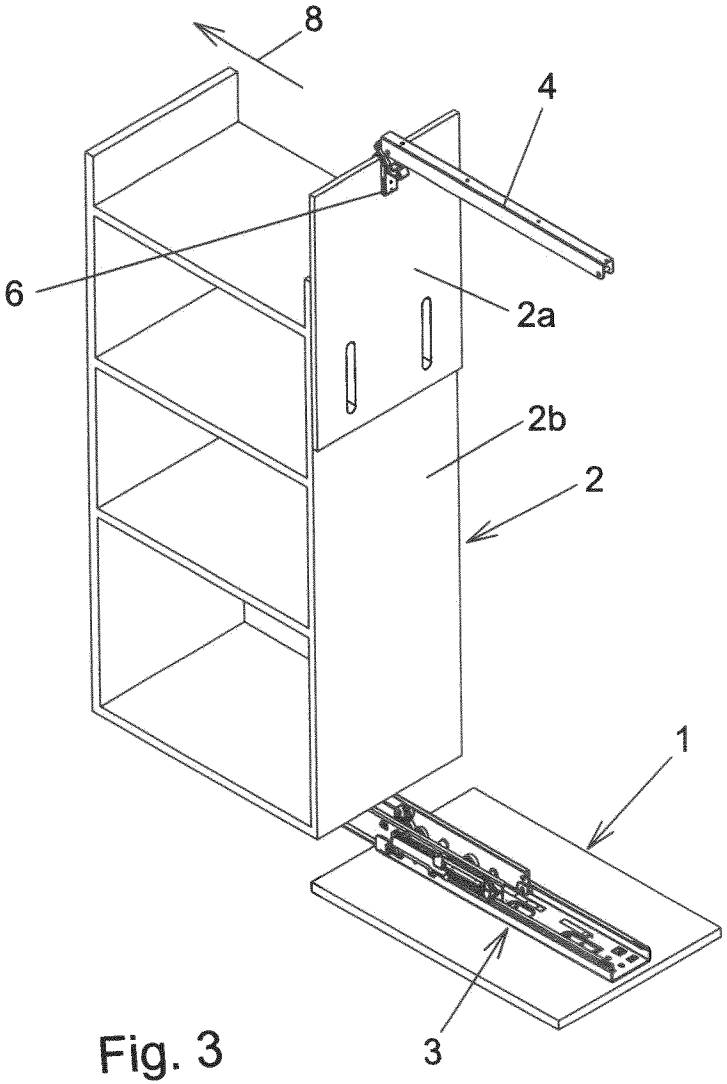
Figure 5:
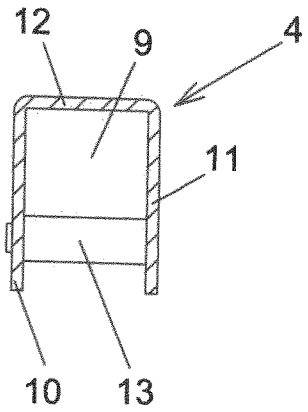
Figure 6:
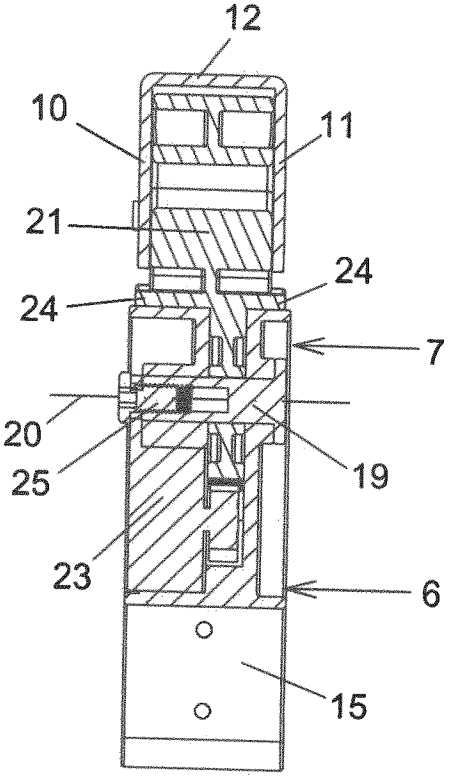
Figure 7:
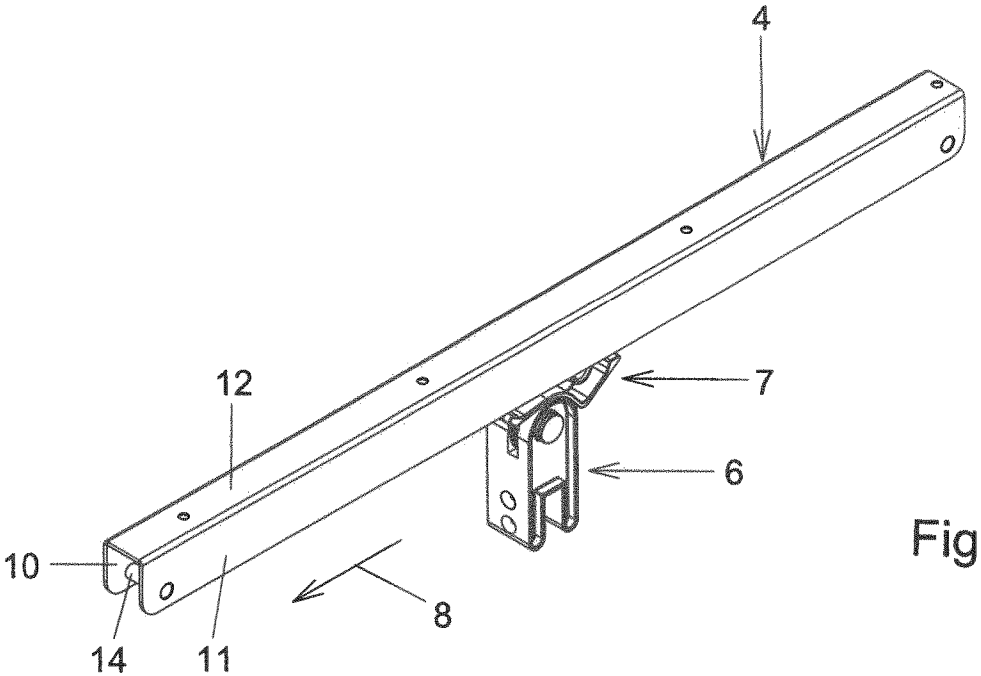
Figure 8:
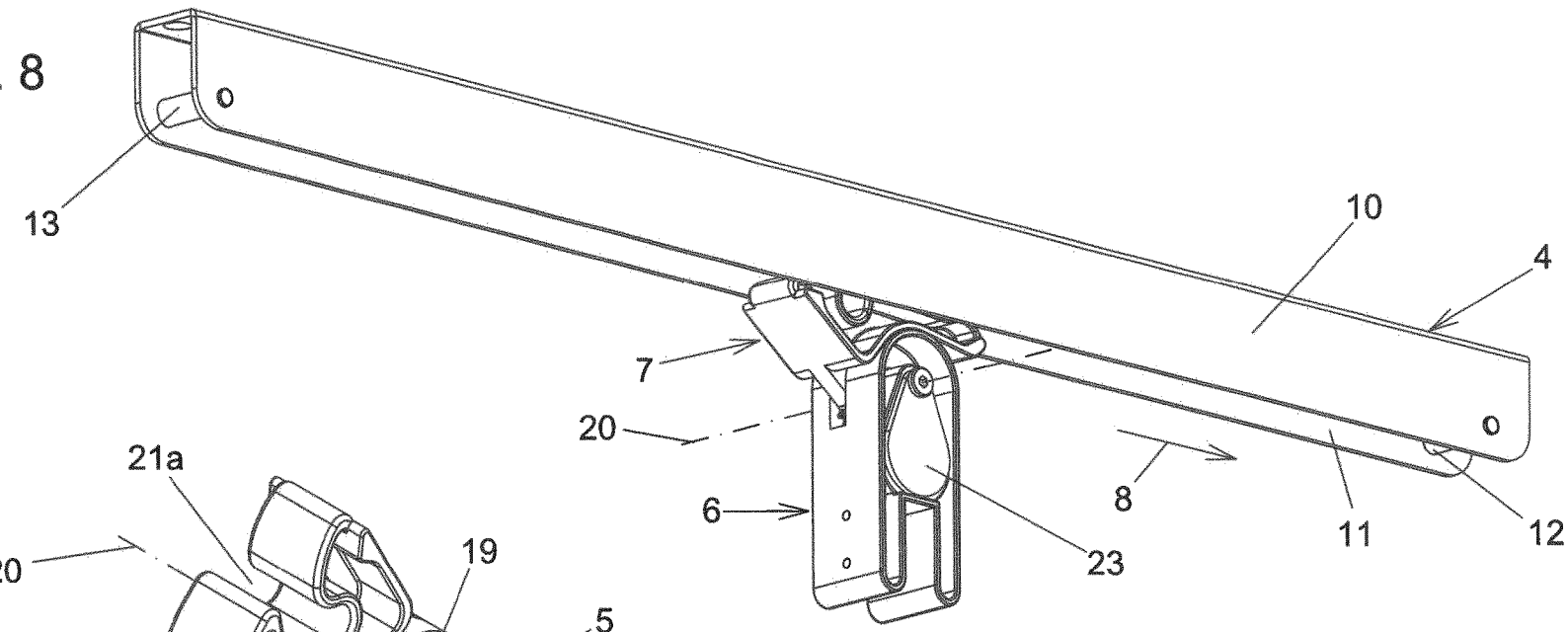
Figure 9:
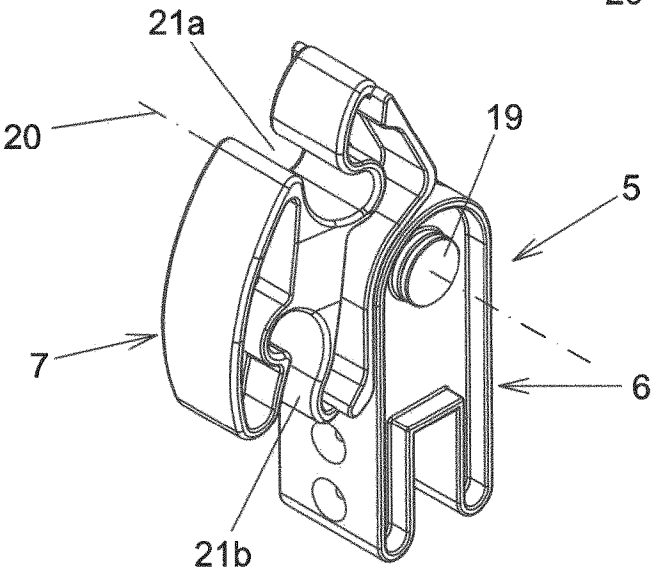
Figure 10:
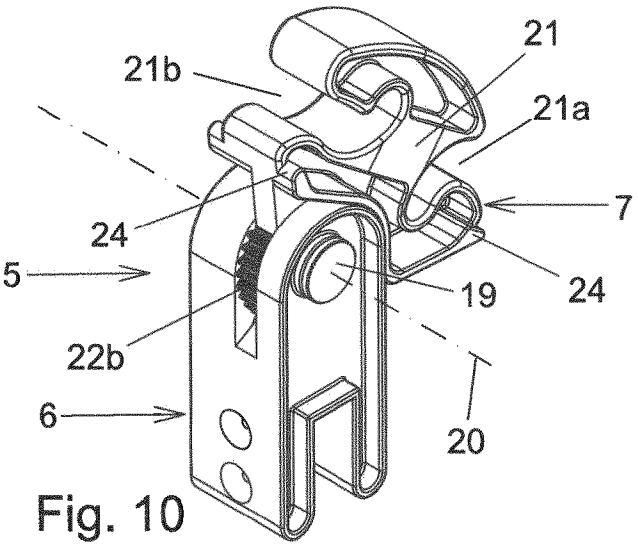
Figure 12:
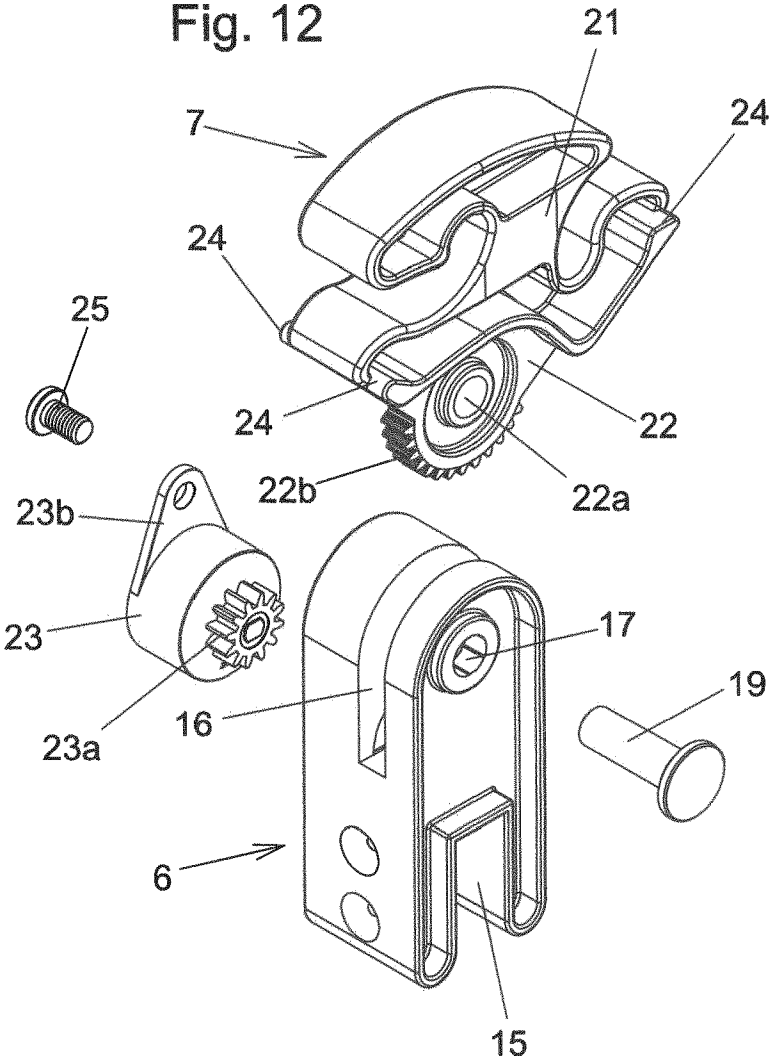
Figure 11:
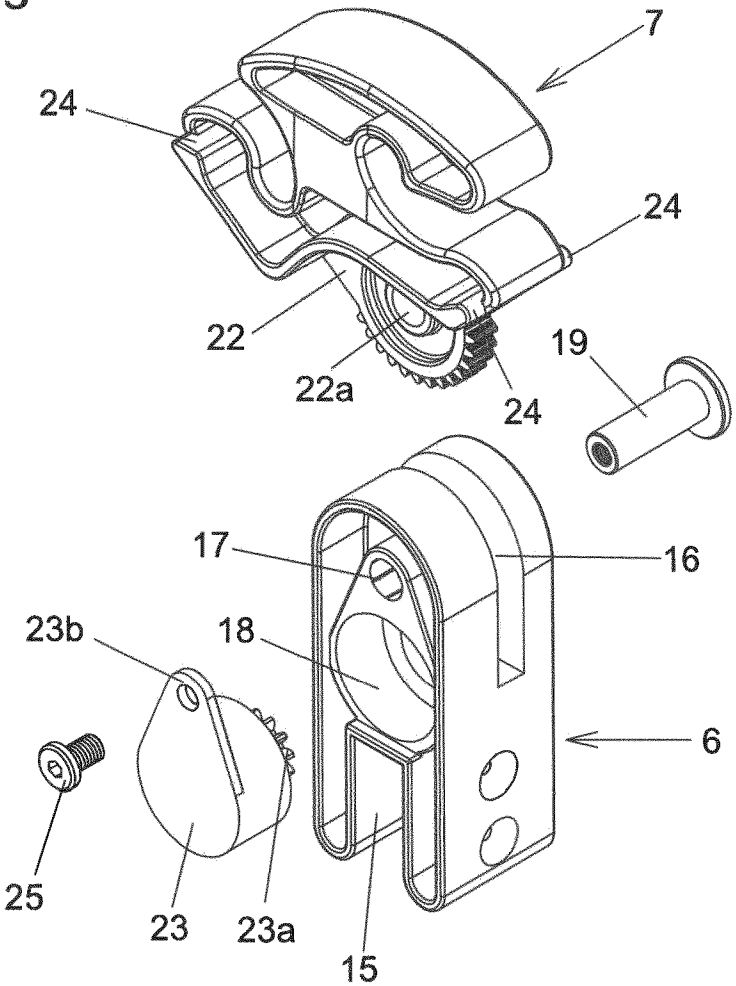
Figure 14:
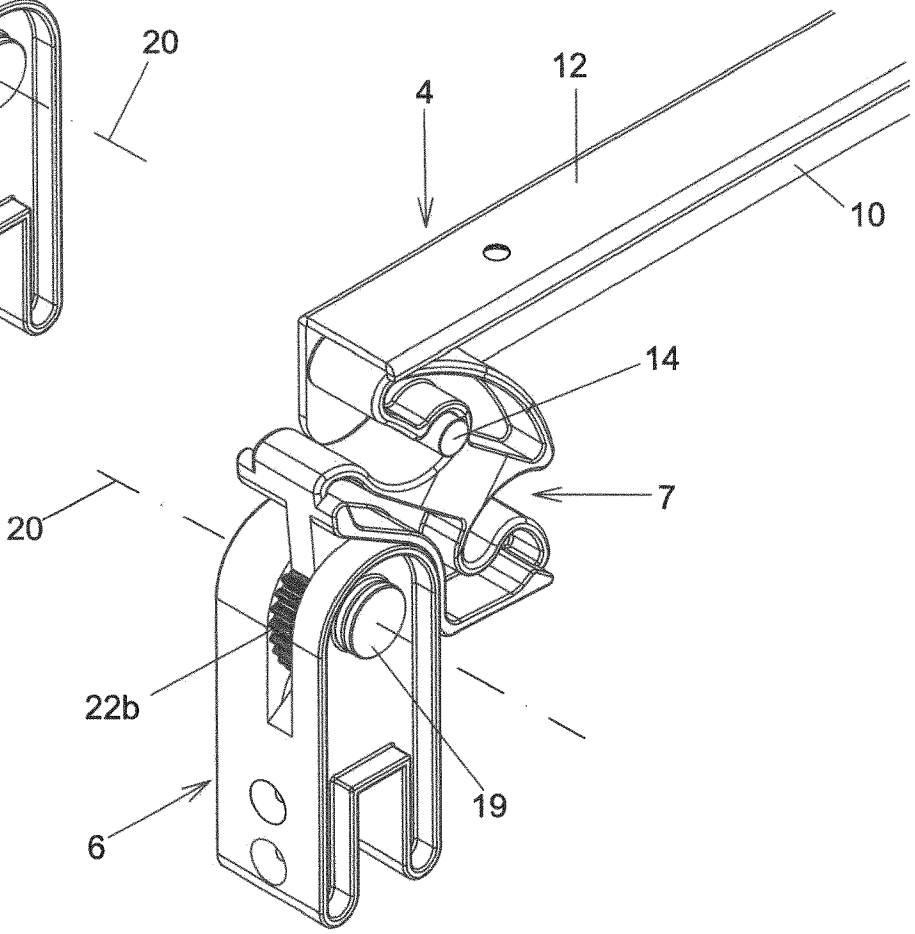
Figure 13:
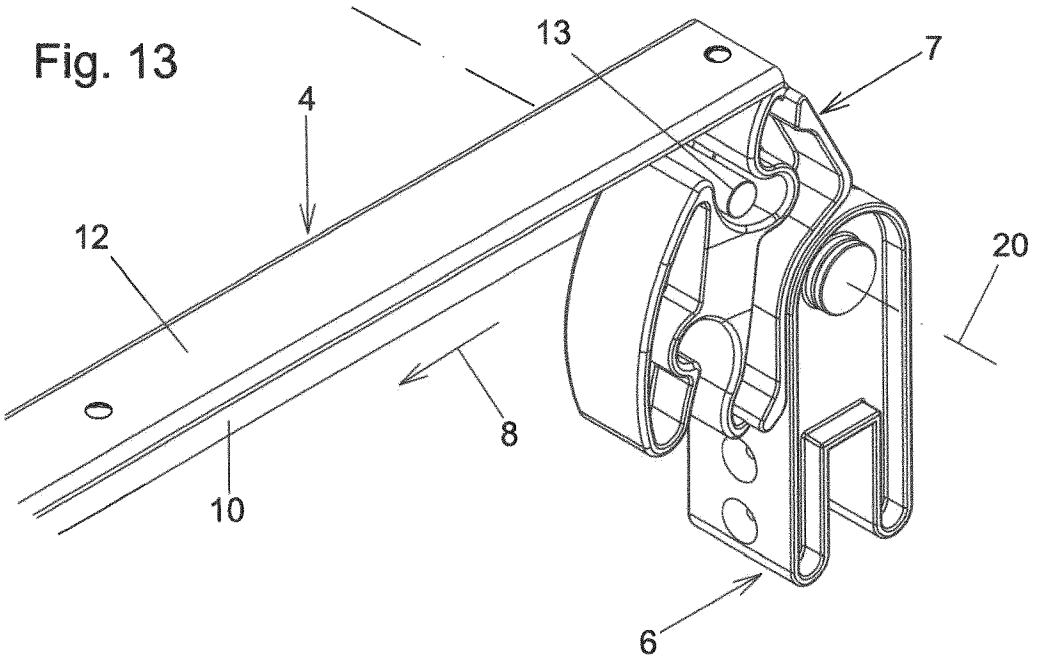
Figure 17:
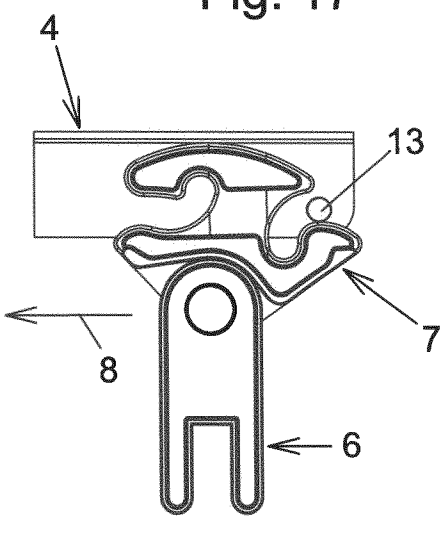
Figure 16:
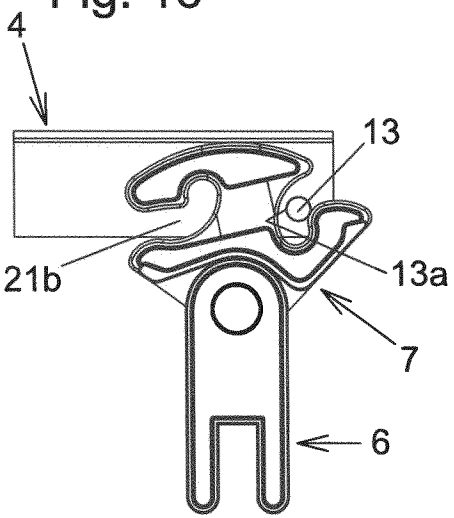
Figure 15:
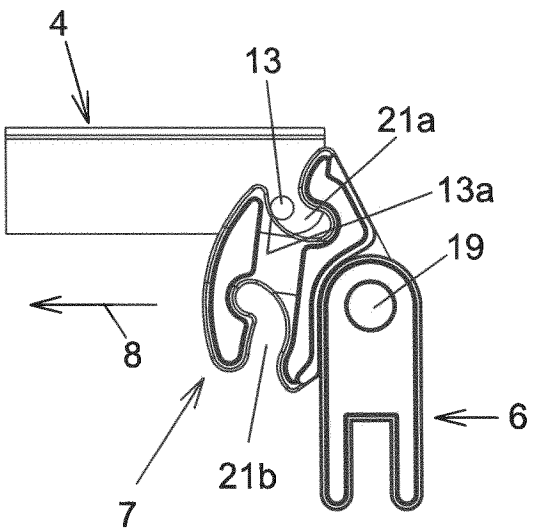
Figure 20:
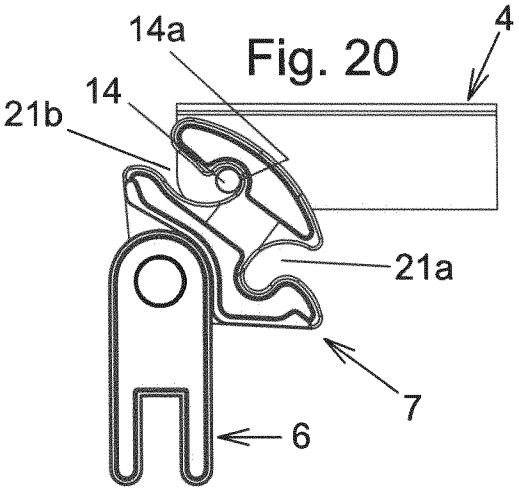
Figure 19:
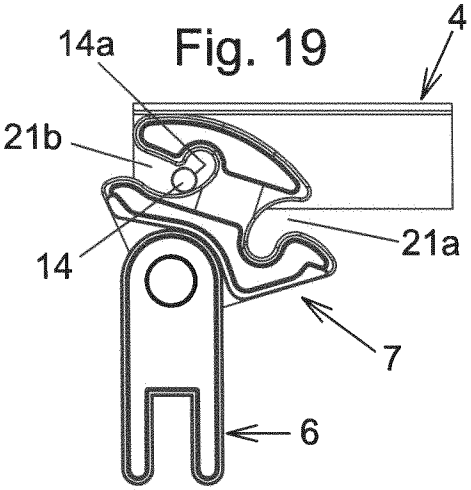
Figure 18:
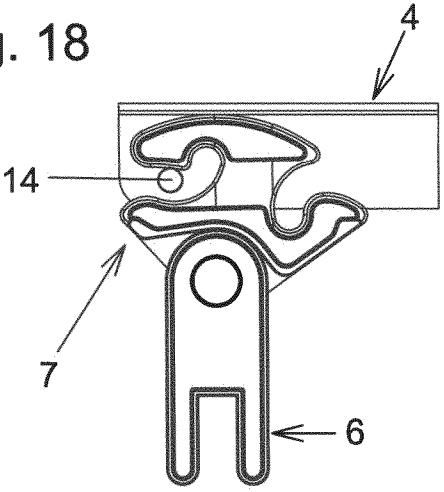
Figure 22:
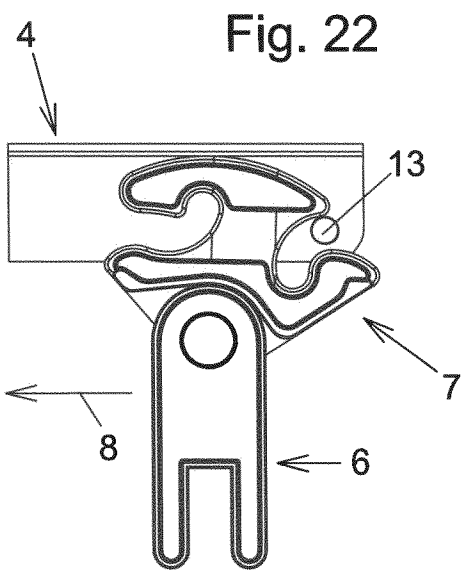
Figure 21:
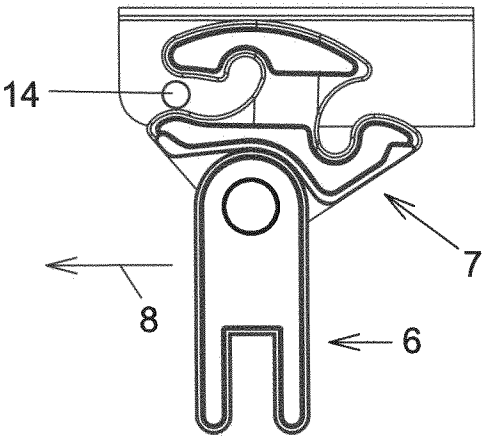

Further advantages and details of the present invention are explained below with reference to the accompanying drawing. In this show:

FIG. 1 an oblique view of a tall cabinet with a device according to an embodiment of the invention in the fully push-in position of the pull-out furniture part;

FIG. 2 an illustration corresponding to FIG. 1 in the fully pull-out position of the pull-out furniture section;

FIG. 3 an illustration corresponding to FIG. 2 from a different viewing direction, with parts of the furniture body removed;

FIG. 4 A side view of the device for lateral guidance in a central position of the mounting part;

FIG. 5 a section along line A-A of FIG. 4;

FIG. 6 a section along line B-B of FIG. 4;

FIG. 7 an oblique view of the device for lateral guidance in a central position of the mounting part;

FIG. 8 an oblique view corresponding to FIG. 7 from a different viewing direction (from diagonally below and from the opposite side);

FIG. 9 an oblique view of the unit guided by the guide rail in the position it occupies when the mounting part is inserted;

FIG. 10 an illustration analogous to FIG. 9, but in the position which the unit assumes in the pull-out position of the mounting part;

FIGS. 11 and 12 Exploded views from different angles;

FIG. 13 an oblique view of the device in the insertion position of the mounting part, the guide rail only partially shown and the front side leg of the guide rail removed;

FIG. 14 an illustration similar to FIG. 13 in the pull-out position of the mounting part;

FIG. 15 a side view of the unit, the guide rail only partially shown and the front side leg removed, in the insertion position of the mounting part;

FIG. 16 an illustration similar to FIG. 15, but with the mounting part in a position in a central area of the initial section of the displacement path during pull-out;

FIG. 17 an illustration similar to FIG. 15, but with the mounting part in the position at the end of the initial section of the displacement path when it is pulled out;

FIG. 18 an illustration similar to FIG. 15, but with the mounting part in a position at the beginning of the end section of the displacement path during pull-out;

FIG. 19 an illustration analogous to FIG. 15, but the mounting part in a position in a central area of the end section of the displacement path during pull-out;

FIG. 20 an illustration similar to FIG. 15, but the mounting part in the pull-out position;

FIG. 21 an illustration similar to FIG. 15, but with the mounting part pushed in in a position at the end of the end section of the pull-out path;

FIG. 22 an illustration analogous to FIG. 15, but the mounting part during push-in in a position at the beginning of the initial section of the pull-out path.

An embodiment of the invention is explained below with reference to the figures. The device according to the invention serves to laterally guide the upper end of a furniture part 2 which can be pulled out of a furniture body 1 in a pull-out direction 8 and pushed in against the pull-out direction 8. The furniture shown is a tall cabinet. The pull-out furniture part 2 is guided by a single pull-out guide 3, which is arranged centrally below the pull-out furniture part 2, and can be pulled out between a fully pushed-in position, see FIG. 1, and a fully pulled-out position, see FIGS. 2 and 3. The pull-out guide 3 can be a differential pull-out, for example. Other types of pull-out guides can also be used, for example telescopic pull-outs.

The pull-out guide 3 preferably enables a full pull-out or an over-pull-out.

The device according to the invention can also be used with furniture other than tall cabinets. In particular, the use of a device according to the invention is expedient if the pull-out furniture part is only guided in a pull-out manner by a single, centrally arranged pull-out guide.

The device according to the invention has a guide rail 4, which is to be attached to the furniture body 1, in particular to the underside of a ceiling part of the furniture body 1.

The device according to the invention also has a unit 5, which is to be attached to the pull-out furniture part. This unit 5 comprises a mounting part 6, which is used to attach it to the pull-out furniture part 2, and a rotary part 7, which is guided by the guide rail 4 so as to be displaceable parallel to the pull-out direction 8, which is parallel to the longitudinal pull-out of the guide rail 4. In relation to the opposite horizontal directions, which are at right angles to the pull-out direction 8, the rotary part 7 is supported by the guide rail 4 against displacement in these directions (apart from bearing play).

The rotary part 7 engages from below in a downwardly open receiving space 9 of the guide rail 4. The receiving space is bounded in the opposite horizontal directions, which are at right angles to the pull-out direction 8, by side legs 10, 11 of the guide rail 4. These side legs 10, 11 project downwards from a horizontal base bar 12 of the guide rail 4. These side legs 10, 11 thus support the rotary part 7 against displacement in the horizontal directions at right angles to the pull-out direction 8. The guide rail 4 has a U-shaped cross-section.

In the region of its rear end relative to the pull-out direction 8, the guide rail 4 has a first engagement element 13, which in the embodiment example is formed by a bolt extending between the side legs 10, 11 horizontally and at right angles to the pull-out direction 8. In the region of its front end relative to the pull-out direction 8, the guide rail 4 has a second engagement element 14, which in the embodiment example is formed by a bolt extending horizontally and at right angles to the pull-out direction 8.

As already mentioned, the mounting part 6 is mounted in the area of the rear end of the pull-out furniture part 2 in relation to the pull-out direction 8, for example in the area of the upper end of an upper rear wall part 2*a* of the pull-out furniture part. This upper rear wall part 2*a* has a recess extending from the upper edge, into which the mounting part 6 is inserted. The mounting part 6 has a recess 15 on its underside, so that the lower section has a U-shape. This is used to attach the mounting part 6 to the lower edge of the recess in the back panel part 2*a* and to screw it to the back panel part 2*a* in this area. Other types of attachment to the rear wall part 2*a* are also possible.

In the embodiment example of the pull-out furniture part shown, the upper rear panel part 2*a* can be adjusted in height relative to a lower rear panel part 2*b* of the pull-out furniture part and can be fixed in the set position by means of screws.

The rotary part 7 is pivoted (=limited rotation) by the mounting part 6 about a horizontal axis of rotation, which is at right angles to the pull-out direction 8. The rotary part 7 can be rotated from a push-in rotational position in a pull-out rotational direction to a pull-out rotational position. In the pull-out rotational position, further rotation in the pull-out rotational direction is blocked; in the push-in rotational position, further rotation against the pull-out rotational direction is blocked.

The area over which the rotary part 7 engages in the receiving space 9 of the guide rail 4 represents an engagement section 21 of the rotary part 7. On the side opposite the engagement section 21, the rotary part 7 has a web-like extension 22, which lies in a vertical plane parallel to the pull-out direction 8. This extension 22 projects into a slot 16 of the mounting part 6. A passage opening 17 through the mounting part 6 passes through this slot 16. This passage opening 17 is coaxial with a passage opening 22*a* through the extension 22. A pin 19 forming the axis of rotation 20 passes through the passage opening 17 of the mounting part 6 and the passage opening 22*a* of the extension. The passage openings 17, 22*a* are thus coaxial with the axis of rotation 20.

The extension 22 has a toothing 22*b* on its narrow side facing away from the engagement section 21, which extends over an arc of a circle. When the rotary part 7 rotates around the axis of rotation 20, the toothing 22*b* rotates around the axis of rotation 20.

A damper 23, which is designed as a rotary damper, is inserted into a recess 18 of the mounting part 6. This has a gear wheel arranged on a shaft with a toothing 23*a*. This engages with the toothing 22*b* of the extension 22. When the rotary part 7 rotates about the axis of rotation 20, the shaft of the damper 23 is thus rotated, whereby this rotation takes place against the resistance applied by the damper.

In the embodiment example, the damper 23 has a protruding tab 23*b*, with which it is screwed to the pin 19 with a screw 25.

The engagement section 21 of the rotary part 7 is delimited by projections 24, which protrude on both sides in directions at right angles to the pull-out direction 8. These projections 24 serve to ensure a central position of the rotary part 7 in a main section of the displacement path, as will be explained in more detail below.

In the engagement section 21 of the rotary part 7, first and second link motion contour 21*a*, 21*b* are formed at the rear and front (in relation to the pull-out direction 8), which interact with the first and second engagement elements 13, 14 of the guide rail 4 formed by the bolts, as also explained below.

The mode of operation is explained below, in particular with reference to FIGS. 15-22. The mounting part 6 can be moved between a push-in position (FIG. 15) and a pull-out position (FIG. 20) by means of a displacement movement. In the push-in position, the pull-out furniture part 2 is in its fully push-in position. In the pull-out position of the mounting part 6, the pull-out furniture part 2 is in its fully pull-out position.

The mounting part 6 is pulled out from the push-in position to the pull-out position in a pull-out direction 8, and pushed in against the pull-out direction 8.

In the insertion position of the mounting part 6, the rotary part 7 rests against an insertion end stop 13*a* of the guide rail 4, see FIG. 15. This is formed by a section of the lateral surface of the first engagement element 13, which is designed as a bolt. The rotary part 7 is in the pushed-in rotational position relative to the mounting part 6 with respect to the rotation about the axis of rotation 20. The first engagement element 13 in the form of a bolt is inserted into the slotted track 21*a* of the rotating piece 7 and rests with its lateral surface forming the pushed-in end stop 13*a* against the wall of the rotary part 7 delimiting the link motion contour 21*a*. If a force directed against the pull-out direction 8 acts on the mounting part 6 in the pushed-in position of the mounting part 6, the bolt exerts a torque on the rotary part 7 about the axis of rotation 20, which acts against the pull-out direction of rotation. However, any further rotation of the rotary part 7 against the pull-out direction rotation is blocked. In the push-in position of the mounting part 6, a displacement of the mounting part 6 against the pull-out direction 8 is therefore blocked.

In the pull-out position of the mounting part 6, the rotary part rests against a pull-out end stop 14*a* of the guide rail 4. This is formed by a section of the lateral surface of the second engagement element 14, which is designed as a bolt, see FIG. 16. The rotary part 7 is located in the pull-out rotary position with respect to a rotation about the axis of rotation 20 relative to the mounting part 6. The second engagement element 14, which is designed as a bolt, is retracted into the link motion contour 21*b* of the rotary part 7 and rests with its lateral surface forming the pull-out end stop 14*a* against the wall of the rotary part 7 delimiting the link motion contour 21*b*. If, in the pull-out position of the mounting part 6, a force directed in the pull-out direction 8 acts on the mounting part 6, the bolt exerts a torque on the rotary part 7 about the axis of rotation 20, which acts in the pull-out direction of rotation. However, any further rotation of the rotary part 7 in the direction of pull-out rotation is blocked. In the pull-out position of the mounting part 6, a displacement of the mounting part 6 in the pull-out direction is thus blocked.

When the mounting part 6 is pulled out from the push-in position in the pull-out direction 8, the rotary part 7 is rotated by the interaction of the first engagement element 13 with the link motion contour 21*a* over an initial section of the displacement path from the push-in rotational position in the direction of a central rotational position, see the movement sequence shown in FIGS. 15 to 17. In the position shown in FIG. 17, the first engagement element 13 is just disengaged from the rotary part 7.

When the mounting part 6 is further pulled out in the pull-out direction 8, the rotary part 7 remains in this middle rotational position over a main section of the displacement path until the mounting part 6 reaches an end section of the displacement path. FIG. 18 shows the position of the mounting part 6 in which the second engagement element 14 has already retracted somewhat into the link motion contour 21*b* of the rotary part 7 and the rotary part 7 just makes contact with the wall delimiting the link motion contour 21*b* on the second engagement element 14. During the further displacement of the mounting part 6 in the pull-out direction 8, the second engagement element 14 moves further into the link motion contour 21*b* of the rotary part 7, whereby it rotates the rotary part 7 about the axis of rotation 20 until the pull-out position of the mounting part 6 is reached, see FIG.

20. FIG. 19 shows a position of the mounting part 6 in a central area of the end section of the displacement path.

When the mounting part 6 is pushed in from the pull-out position to the push-in position, the movement sequence is essentially reversed. FIG. 21 shows the position of the mounting part 6 in which the second engagement element 14 is just disengaged from the rotary part 7. FIG. 22 shows the position of the mounting part 22, in which the rotary part 7 has just come into engagement with the first engagement element 13.

The projections 24 of the rotary part 7 serve to ensure the central rotational position of the rotary part 7 over the main section of the displacement path. These interact with the downward-facing narrow sides of the side legs 10, 11 and thus prevent rotation of the rotary part 7, apart from any play.

Over the initial section of the displacement path, the projections 24 at the rear with respect to the pull-out direction 8 are out of engagement with the side legs 10, 11 of the guide rail, so that when the mounting part 6 is pushed in, rotation of the rotary part 7 from the central rotational position to the push-in rotational position is possible. Over the area of the end section of the displacement path, the front projections 24 in relation to the pull-out direction 8 are out of engagement with the side legs 10, 11 of the guide rail 4, so that when the mounting part 6 is extracted, the rotation of the rotary part 7 from the central rotational position to the pull-out rotational position is possible.

By rotating the rotary part 7 between the push-in rotational position and the pull-out rotational position, the displacement path is extended, which allows the mounting part 6 to be moved relative to the guide rail 4.

The rotation of the rotary part 7 around the axis of rotation 20 is damped by the damper 23. Therefore, when the pull-out furniture part is pulled out, the braking of the pull-out furniture part (in the area of its upper end) is damped before it reaches its fully pull-out position. When the pull-out furniture part is pushed in, the pull-out furniture part is braked (in the area of its upper end) before reaching the fully push-in position.

In principle, it would also be conceivable and possible to rotate the rotary part only via the initial section of the displacement path or only via the end section of the displacement path relative to the mounting part. Rotation both over the initial section and over the end section of the displacement path has the particular advantage that both the end stop when pulling out and the end stop when pushing in are damped by means of the rotation damper 23.

The link motion contours 21*a*, 21*b* are curved in the embodiment example, as is preferred. This makes it possible to adjust the course of the damping force when pulling out over the end section of the displacement path and when pushing in over the initial section of the displacement path.

In the embodiment example, the link motion contour 21*b* has an internal end section which, in the pull-out rotational position of the rotary part 7, forms an upward bulge in which the bolt forming the second engagement element is located in the pull-out position, see FIG. 20. When the device according to the invention is mounted, the rear wall part 2*a* with the device according to the invention mounted thereon can thus be attached to the guide rail 4 in the pull-out position of the mounting part 6. In this position, the rear wall part 2*a* can be connected to the rear wall part 2*b*. This ensures the correct height of the rear wall part 2*a*.

Various further modifications of the embodiments shown are conceivable and possible without departing from the scope of the invention as defined in the claims. For example, it would be conceivable and possible to form the engagement elements 13 and/or 14 of the guide rail as parts with link motion contours, for example made of plastic, which are inserted into the profile of the guide rail, in particular consisting of metal, and which interact with at least one or two bolts arranged on the rotary part 7.

In principle, it would also be conceivable and possible to design the guide rail with a cross-section other than U-shaped, for example a V-shaped cross-section.

The damper 23 could also be secured in the mounting part 6 in another way instead of using a screw 25, for example by snapping it into place. It could, for example, be secured against rotation by at least one rib that runs parallel to the axis of rotation and engages in a groove in the wall of the recess 18. The pin 19 forming the axis of rotation could be snapped into the passage opening 17.

KEY TO THE REFERENCE NUMBERS

1 Furniture body
2 pull-out furniture part
2*a* Back panel part
2*b* Back panel part
3 Pull-out guide
4 Guide rail
5 Unit
6 Mounting part
7 Rotary part
8 Pull-out direction
9 Receiving space
10 Side leg
11 Side leg
12 Base bar
13 first engagement element
13*a* Push-in end stop
14 second engagement element
14*a* Pull-out end stop
15 Recess
16 Slot
17 Passage opening
18 Recess
19 Pin
20 Axis of rotation
21 Engagement section
21*a* Link motion contour
21*b* Link motion contour
22 Extension
22*a* Passage opening
22*b* Toothing
23 Damper
23*a* Toothing
23*b* Tab
24 Projection
25 Screw

The invention claimed is:

1. A device for lateral guidance of the upper end of a pull-out furniture part (2), which can be pulled out from a position completely pushed into a furniture body (1) in a pull-out direction (8) to a position completely pulled out of the furniture body (1), comprising:

a guide rail (4) which can be fastened to the furniture body (1) and the longitudinal extent of which is parallel to the pull-out direction (8);

a rotary part (7) which is guided by the guide rail (4) parallel to the pull-out direction (8) and which is mounted on a mounting part (6) which can be fastened to the pull-out furniture part, the rotary part (7) pivotable about a horizontal axis of rotation (20) lying at right angles to the pull-out direction (8), wherein the mounting part (6) is movable relative to the guide rail (4) from a push-in position, which can be occupied by the mounting part (6) in the fully push-in position of the pull-out furniture part (2), in the pull-out direction (8) via a displacement path up to a pull-out position which can be occupied by the pull-out furniture part (2) in the fully pull-out position, and wherein, in the push-in position of the mounting part (6), the rotary part (7) rests against a push-in end stop (13*a*) of the guide rail (4) and assumes a push-in rotational position relative to the mounting part (6) and, in the pull-out position of the mounting part (6), rests against a pull-out end stop (14*a*) of the guide rail (4) and assumes a pull-out rotational position relative to the mounting part (6), which is rotated about the axis of rotation (20) relative to the push-in rotational position; and wherein, when the mounting part (6) is displaced, starting from the push-in position in the pull-out direction (8) over an initial section of the displacement path, the rotary part (7) is rotated about the axis of rotation (20) relative to the mounting part (6) by the interaction of the rotary part (7) with a first engagement element (13) of the guide rail (4) and, during the displacement of the mounting part (6) over a main section of the displacement movement following the engagement section, the rotational position of the rotary piece (7) about the axis of rotation (20) remains unchanged relative to the mounting part (6).

2. The device according to claim 1, wherein the rotation of the rotary part (7) is damped by a damper (23) when the mounting part (6) is displaced against the pull-out direction (8) over the initial section of the displacement path until the push-in position of the mounting part (6) is reached.

3. The device according to claim 1, wherein when the mounting part (6) is displaced in the pull-out direction (8) over an end section of the displacement path before reaching the pull-out position, the rotary part (7) is rotated about the axis of rotation (20) relative to the mounting part (6) by the interaction of the rotary part (7) with a second engagement element (14) of the guide rail (4).

4. The device according to claim 3, wherein the rotation of the rotary part (7) is damped by a damper (23) when the mounting part (6) is displaced in the pull-out direction (8) over the end section of the displacement path until the pull-out position of the mounting part (6) is reached.

5. The device according to claim 2, wherein the rotary part has a toothing (22*b*) which is coaxial with the axis of rotation (20) and which meshes with a toothing (23*a*) coupled to the damper (23).

6. The device according to claim 1, wherein the guide rail (4) has a downwardly open receiving space (9) which is limited by side legs (10, 11) and into which an engagement section (21) of the rotary part (7) projects.

7. The device according to claim 6, wherein the side legs (10, 11) project downward from a horizontal base bar (12) of the guide rail (4).

8. The device according to claim 1, wherein the push-in end stop (13*a*) is formed by a section of a lateral surface of a first engagement element (13) of the guide rail (4), which is designed as a bolt and engages in a link motion contour (21*a*) of the rotary part (7) when the mounting part (6) is displaced over the initial section of the displacement path.

9. The device according to claim 1, wherein the pull-out end stop (14*a*) is formed by a section of a lateral surface of a second engagement element (14) of the guide rail (4), which is designed as a bolt and engages in a link motion contour (21*b*) of the rotary part (7) when the mounting part (6) is displaced over the end section of the displacement path.

10. The device according to claim 2, wherein the damper (23) is designed as a rotation damper.

11. The device according to claim 4, wherein the damper (23) is designed as a rotation damper.

* * * * *